US005522579A

United States Patent [19]

Röck

[11] Patent Number: 5,522,579

[45] Date of Patent: Jun. 4, 1996

[54] APPARATUS FOR SUPPORTING A FORM MEMBER EXTENDING PERPENDICULARLY TO THE LONGITUDINAL AXIS OF A FORM CARRIER

[75] Inventor: Ernst Röck, Amstetten, Austria

[73] Assignee: Osterreichische DOKA Schalungstechnik GmbH, Amstetten, Austria

[21] Appl. No.: 134,901

[22] Filed: Oct. 13, 1993

[30] Foreign Application Priority Data

Nov. 6, 1992 [DE] Germany ..... 42 37 595.9

[51] Int. Cl.[6] ..... E04G 17/00

[52] U.S. Cl. ..... 249/219.1; 249/211

[58] Field of Search ..... 249/23, 139, 219.1, 249/207, 210, 211

[56] References Cited

U.S. PATENT DOCUMENTS

| | | | |
|---|---|---|---|
| 1,535,256 | 4/1925 | Saunier | 249/219.1 |
| 1,682,740 | 9/1928 | Colt | 249/219.1 |
| 2,868,250 | 1/1959 | Holmboe, Sr. | 249/219.1 |
| 3,220,691 | 11/1965 | Dudley | 249/219.1 |
| 3,491,981 | 1/1970 | Harbert | 249/219 |
| 3,711,059 | 1/1973 | Kistler | 249/219.1 |
| 3,771,757 | 11/1973 | Black | 249/219 |
| 4,101,111 | 7/1978 | Bishop | 249/219.1 |
| 5,076,536 | 12/1991 | Fitzgerald | 249/219.1 |

FOREIGN PATENT DOCUMENTS

| | | | |
|---|---|---|---|
| 1684236 | 4/1971 | Germany . | |
| 2260359C3 | 6/1974 | Germany . | |
| 2302498 | 7/1974 | Germany . | |
| 3148217A1 | 6/1983 | Germany . | |
| 3503692 | 7/1986 | Germany . | |
| 273466 | 11/1989 | Germany | 249/219.1 |
| 9101523.5 | 2/1991 | Germany . | |

OTHER PUBLICATIONS

"Uterzugschalung mit Holzträgern", System Hunnebeck, Hünnebeck–Röero GmbH, Aufbauanleitung Stand: März 1991.

"Peri UZ–Schalung", Peri GmbH, Handbook 92, Issue 1/92.

*Primary Examiner*—James P. Mackey

*Attorney, Agent, or Firm*—Finnegan, Henderson, Farabow, Garrett and Dunner

[57] ABSTRACT

Apparatus for supporting a form member extending perpendicularly to the longitudinal axis of a form carrier, in particular for supporting the side face of a truss form for concrete. The apparatus has a support frame and a clamping device connected to the support frame. A tightening device and a holding member are arranged in such a manner in a knuckle joint arrangement that, upon tightening, a prestressing path for the apparatus along the form carrier, and, thus a prestressing force perpendicular to the plane of the side face, ensues so that the gap between the side face and the base plate remains sealed in a reliable manner despite the concrete pressure, which arises. In a preferred embodiment, the truss holder is provided with an adjustable carrier adjustable in height, and which can be adapted to the required truss height.

18 Claims, 7 Drawing Sheets

APPARATUS FOR SUPPORTING A FORM MEMBER EXTENDING PERPENDICULARLY TO THE LONGITUDINAL AXIS OF A FORM CARRIER

BACKGROUND OF THE INVENTION

1. Field of Invention

The invention relates to an apparatus for supporting a form member extending perpendicularly to the longitudinal axis of a form carrier. Such apparatus are generally called truss holders.

2. Description of Related Art

Such a truss holder is known, for example, from the preprint of the construction instructions "Truss form with wooden carriers (Unterzugschalung mit Holzträgern)" (Status: March 1991) of the company Huennebeck-Roero GmbH. In this construction, the support member consists of a hollow profile with two blocks located thereon. The supporting frame is placed with these supporting blocks on the upper side of a profile transverse carrier of a truss form. A screw bolt is inserted through the hollow profile of the support member perpendicularly to the longitudinal axis of the profile transverse carrier, and a plate-shaped bracket is secured to the support member at its lower end. The bracket can be rotated between the hollow profile of the support member and the upper flange of the profile transverse carrier. Thus, by turning the bracket, its holding brackets can be engaged with the lower side of the upper flange of the profile transverse carrier. By tightening a wing-nut on the screw bolt, the truss holder can subsequently be tightened against the profile transverse carrier.

In tightening the truss holder against the profile transverse carrier, a clamping force is only applied in the direction parallel to the side face of the form skin. Consequently, there is no force component which can act directly against the concrete pressure on the side face. Therefore, it often arises that the side face of the form skin is pushed back a few millimeters in the direction of the profile transverse carrier when concreting the truss so that concrete escapes between the base plate and the form skin of the side face through the gap which has been created.

A truss holder is known from the Handbook 92 (Issue 1/92) of Peri GmbH by means of which clamping force components are applied in the direction parallel to as well as perpendicular to the side face of the form skin. On the supporting frame, a screw bolt is arranged in a direction inclined to the side face, a clamping hook being mounted to the lower end thereof. In this solution, two profile transverse carriers of the truss form are arranged in parallel directly adjacent one another and a perforated rail is inserted between both profile transverse carriers in the area beneath the base plate of the form skin. Respectively two truss holders arranged opposite one another on both side faces of the truss form are then braced by means of the clamping hooks hooked into the perforated rail.

In this construction, a further part in the form of the perforated rail is required in addition to the truss holder and a bracing of the truss holders can only ensue after both opposing truss holders as well as the perforated plate are mounted. Furthermore; respectively two profile transverse carriers must be arranged adjacent one another in order to be able to lay the truss holders and the perforated rail.

SUMMARY OF THE INVENTION

The invention is therefore based on the problem of providing a truss holder by means of which a prestressing can be applied to the side face of the form skin of a truss form in the direction perpendicular to the side face surface.

In the inventive truss holder, the knuckle joint arrangement of the clamping means and the gripping means have the effect that, in tightening the truss holder mounted, for example, to a wooden form carrier, the clamping means and the gripping means are moved out of their angular alignment in the prestressed state into a substantially coaxial arrangement. In this manner, a horizontal tightening path ensues, and thus also a biasing of the truss holder in the direction perpendicular to the side face. The truss holder can in this case itself be mounted and tightened without further parts being required for tightening thereof. The inventive truss holder is secured to a single carrier of the truss form, which can be different in terms of material and shape.

In accordance with the invention, it is favourable if a screw bolt is used as the clamping means of the truss holder which can be tightened against the support frame by means of a suitable screw nut. In order to ensure safe tightening of the truss carrier, for example by means of a hammer, the use of a star nut is suitable.

Furthermore, for the jointed connection of the tightening and gripping means, it is advantageous to shape the end of the screw bolt near the joint in the form of a bracket.

Furthermore, it is advantageous in accordance with the invention to provide two substantially similar clamping brackets as gripping means which can be connected with one another in a form- and force-locked manner. Usefully, the clamping brackets respectively have a straight leg as well as a bent section connected to this. The clamping brackets can then be placed on top of one another with their bent sections and in such a manner that the concave inner surfaces of the clamping brackets face one another. In order to achieve a good form-lock of the superimposed clamping brackets, it is favourable to select the outer radius of the bent section of the lower clamping bracket to be the same as the inner radius of the bent section of the upper clamping bracket. Furthermore, it is useful to form the straight leg of the upper clamping bracket that much longer that both free ends of the straight leg of the superimposed clamping brackets are flush with one another, i.e. that they end at the same level. If the clamping brackets are placed on one another in the described manner and inserted into the bracket at the end of the screw bolt near the joint, they can be displaced with respect to one another and can be folded laterally out of the plane defined by the support frame so that the clamping brackets can be placed around a carrier of the truss form.

Additionally, it is advantageous in accordance with the invention if the clamping brackets respectively have a through hole and if a bolt is respectively provided on the support member on both sides perpendicular to the longitudinal axis of the carrier, both bolts fitting through the through hole of the clamping bracket. In this case, it is useful to provide the free ends of the bolts respectively with a radially widening collar section which holds an axially displaceable stop disc on the bolt in such a manner that it cannot be lost, the outer diameter of the stop disc being greater than the diameter of the through hole of the clamping bracket. Thus, both clamping brackets remain mutually displaceable and openable with respect to one another on account of their freedom of movement relative to the respective bolt for mounting the truss holder, and are simulataneously held in their functional position by means of the stop discs and the collar sections of the bolts in a manner in which they cannot be lost. The inner diameter of the stop discs are in this case smaller than the outer diameter of the collar sections. In accordance with the invention, it is advantageous if the gripping means has two claws. Here it is preferred to form the claws to be respectively substantially plate-like and to arrange these at such an angle that when the truss holder is mounted and prestressed, the claws only lie with one edge extending perpendicularly to the carrier longitudinal axis on the contacting surface of the carrier of the truss form and the middle surface of the claws define an angle of a few degrees with the contacting surface of the carrier. In this manner, when securely tightening the truss holder, the support edge of the claw is pressed against the material of the carrier of the truss form and, on account of the coaxial alignment of both knuckle joint members which occurs upon tightening, the claws rotate about the contacting surface and in fact to a maximum until either the claw lies entirely against the support surface of the carrier of the truss form or until both knuckle joint members are coaxially aligned. On account of this rotational movement of the clamping brackets about the support edge of the claws on the carrier, the support frame of the truss holder moves parallel to the carrier longitudinal axis in the direction towards the side face of the form skin via the bolts mounted to the support member and engaged with the clamping brackets. On account of this tightening path, a corresponding bias occurs in the direction perpendicular to the side face and a sealing of the gap between the base plate and the side face is created.

In accordance with an advantageous embodiment of the invention, the claw is formed as a flat plate. In a preferred embodiment, the claw has over its entire contacting surface a toothing extending substantially perpendicular to the carrier longitudinal axis, on account of which a particularly good and secure contact of the claw is achieved. In further preferred embodiments, an elevation is provided on the contacting surface of the claw, the elevation extending across the width of the claw perpendicular to the carrier longitudinal axis and being arranged either in the middle of the contacting surface or on the edge of the contacting surface facing the side face. In a further preferred embodiment, the claw is formed as a plate which is bent up towards the contacting surface on the carrier at the end face facing in the direction of the side face. The embodiment of the claw in which an elevation is provided at the edge of the plate-like claw is particularly suited for mounting the truss holder on metal carriers, for example of aluminum or steel, which have a profile at the lower side of the upper flange of the carrier.

It is preferred in accordance with the invention to form the support member as a support rail which is formed either of two L-profiles or of an U-profile. The support rail guides the support frame along the form carrier as the side faces of the form carrier are also surrounded by the profile flanges. On account of this, the support frame is also guided particularly along the tightening path upon tightening the truss holder. Furthermore, it is favourable to form the support member as a substantially U-shaped profile with through holes arranged in a grid-like manner in the profile flanges.

It is preferable to apply an adjustable carrier, known in principle, on the support member which is displaceable parallel to the longitudinal axis of the support member. Such an adjustable carrier suitably consists of two parallel perforated plates and of a holding plate arranged perpendicular thereto, the perforated plates having through holes matching the through holes of the supporting member and being arranged in grids adapted to each other. The adjustable carrier can therefore be adapted in terms of its height adjustment to correspond to the required truss height and be fixed with respect to the support member by means of a holding bolt which is inserted through the through holes of the adjustable carrier and the support member.

The inventive truss holder is suitable for different types of form carriers in truss forms, for example for profiled wooden truss carriers, for square timber and for metal carriers of steel or aluminum. For using the inventive truss holder for square timber carriers, it is useful to form the straight legs of the clamping brackets appropriately longer in accordance with the thickness of the square timber.

The truss holder according to the invention is easily and quickly mountable and a flowing of concrete out of the form skin through the gap between the side face and the base plate is reliably prevented. The inventive truss holder can additionally be used for example for bracing side faces in ceiling forms.

BRIEF DESCRIPTION OF THE DRAWINGS

In the following, the invention is described in more detail by way of example with reference to the enclosed drawings, in which.

DESCRIPTION OF PREFERRED EMBODIMENT

Figure 1:
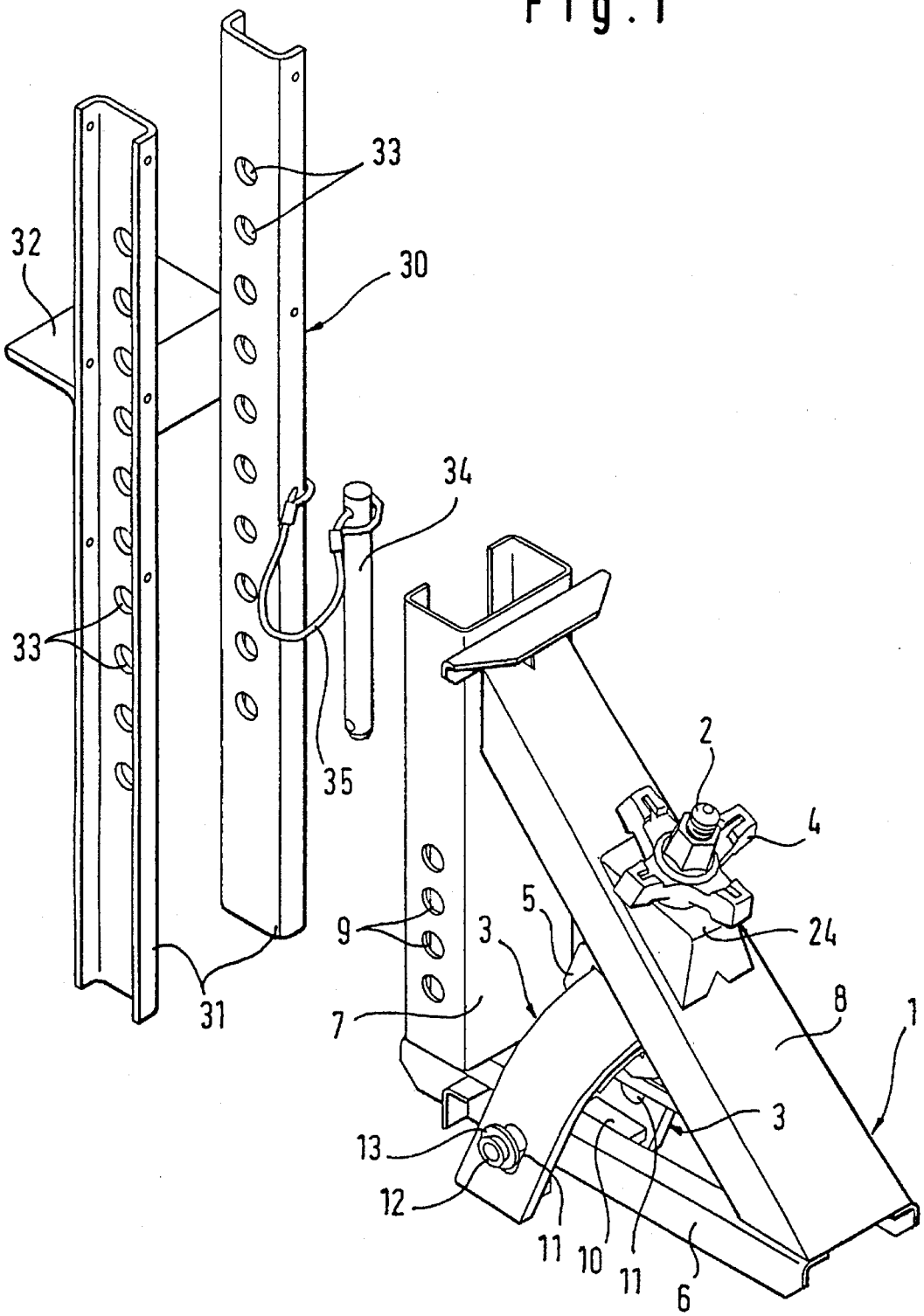
FIG. 1 shows a truss holder and adjustable carrier in a perspective view.
Figure 2:
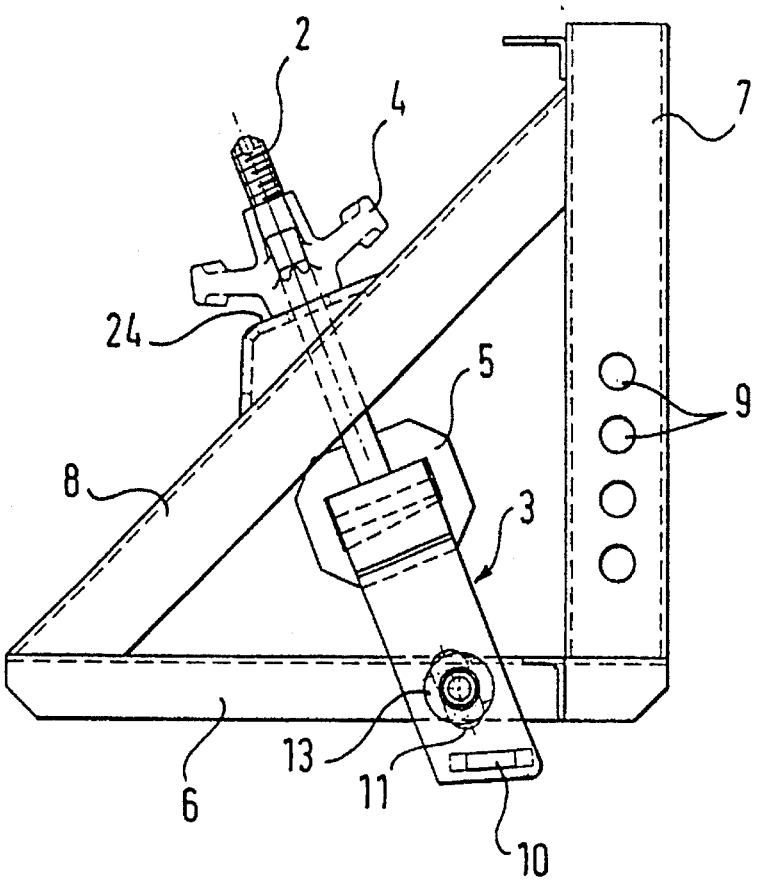
FIG. 2 shows a truss holder in side view.
Figure 3:
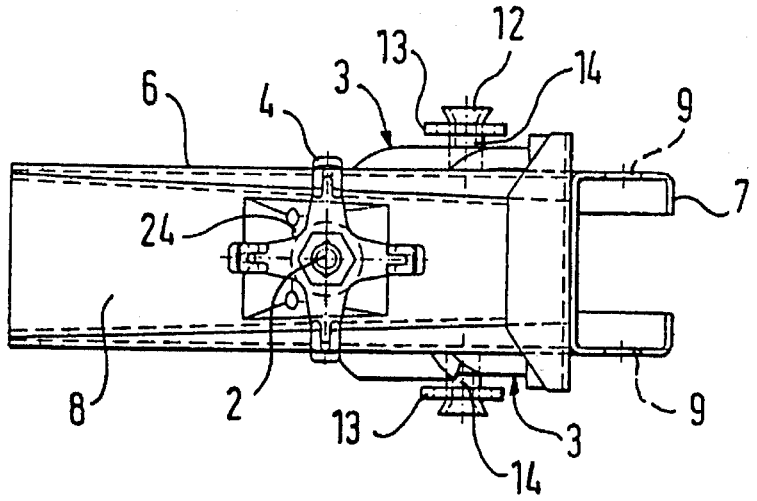
FIG. 3 shows a truss holder in plan view.

As can be seen in FIG. 1, FIG. 2 and FIG. 3, the truss carrier 1 has a support frame which is formed by the support rail 6, the support strut 7 and the connecting strut 8. Here the support strut 7 is arranged perpendicular to the support rail 6 securely connected with this, and the support strut 7 and the support rail 6 are securely connected in the region of their free ends by the connecting strut 8 so that a substantially triangular structure of the support frame ensues. The support strut 7 is a substantially U-shaped profile, the flanges of which are formed as perforated plates with circular through holes 9 arranged in a grid-like manner. The support rail 6 is formed of two parallel spaced L-profiles. The width of the support rail is selected according to the type of form carrier used in such a manner that the flanges of the L-profiles surround the form carrier, and the support frame is thus guided along the support carrier. The support rail can also be formed as a U-profile. A support 24 is formed on the connecting strut 8 through which a screw bolt 2 is guided. The screw bolt 2 acts together with a star nut 4 which can be securely tightened against the support 24. A bracket 5 is mounted on the end of the screw bolt 2 inside the support frame. Two superimposed holding brackets 3 are arranged on both sides of the support rail and are connected by means of the bracket 5 in a hinged manner with the screw bolt 2. An oblong hole 11 is provided in the straight leg of each holding bracket 3.

It can be seen in FIG. 3 that a bolt 14, which for example can be a hollow bolt, is securely mounted to the side surfaces of the support rail 6 perpendicular to the plane defined by the support frame, the free ends of the bolts being expanded in a collar-like manner and on which a stop disc 13 is held by these collar sections 12 in a manner such that they cannot be lost. The bolts 14 are respectively inserted through the oblong holes 11 of the associated holding bracket 3, the stop disc 13 respectively being between the collar section 12 and the holding bracket 3. On account of the fact that the stop disc 13 has a greater outer diameter than the oblong hole 11 of the holding bracket 3, both holding brackets 3 are respectively secured against loss, as the stop disc itself is secured by the collar section 12. Furthermore, a claw 10 is mounted respectively in the area of the free end of the straight leg of the holding bracket 3, as FIG. 1 and FIG. 2 show. This claw 10 is substantially plate-like in shape and arranged perpendicular to the inner surface of the straight leg of the holding bracket 3.

FIG. 1 also shows an adjustable carrier 30 with two parallel perforated plates 31 having a U-profile which, in terms of their spacing, fit the width of the support strut 7 so that the adjustable carrier can be placed onto the support strut. A holding plate 32 is provided on the adjustable carrier which lies perpendicular to the perforated plates 31 and upon which a side carrier 52 of the truss form (cf. FIG. 4*a*) can be placed. In accordance with the desired truss height, the adjustable carrier 30 can be fixed with a holding bolt 34 in terms of its height on the support strut 7. The through holes 33 of the perforated plates 31 have the same diameter as the through holes 9 in the support strut 7 and the through holes of the perforated rail and the support strut are arranged in a grid which are matched with respect to one another. The holding bolt 34 is fastened to the adjustable carrier by means of a safety cord 35.

Figure 4A:
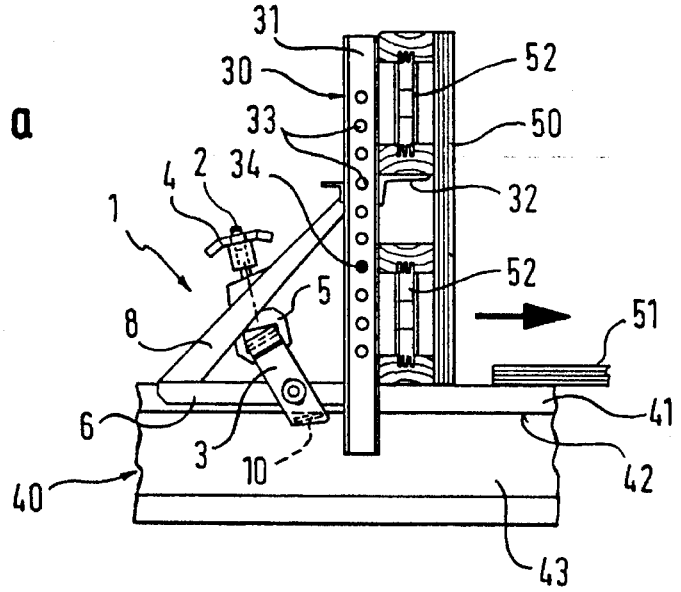
FIG. 4*a* shows a truss holder with an adjustable carrier in side view during placement against the truss form.
Figure 4B:
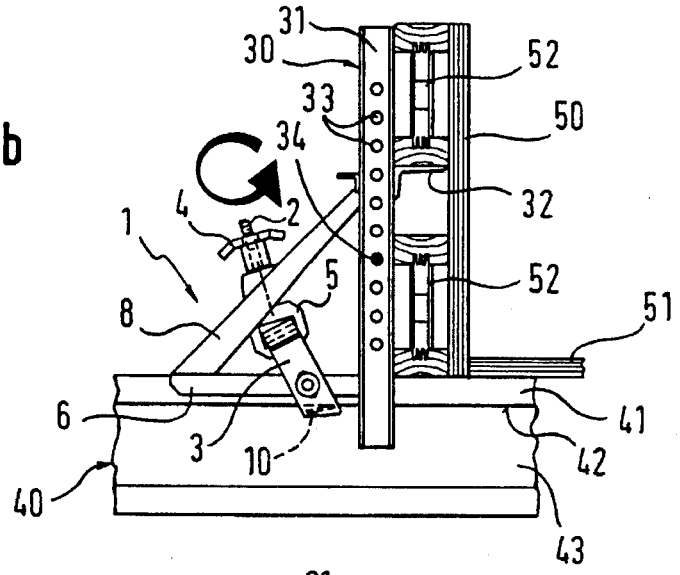
FIG. 4*b* shows a truss holder with an adjustable carrier in side view prestressed on the truss form.
Figure 4C:
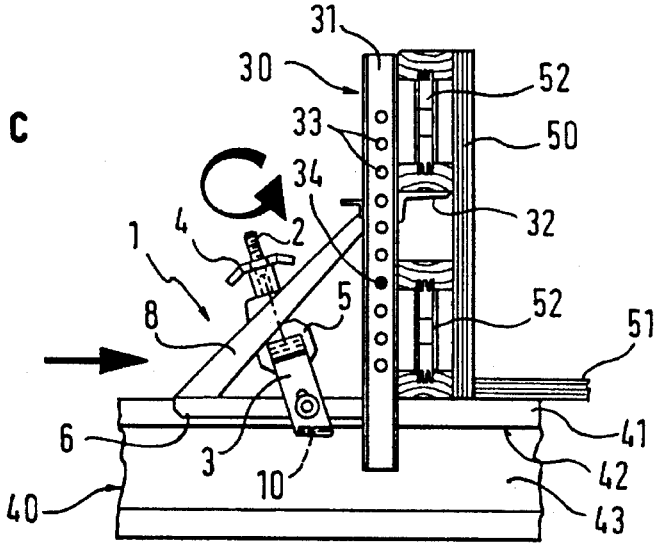
FIG. 4*c* shows a truss holder with an adjustable carrier in side view in the final tightened state on the truss form.

The necessary steps for mounting the truss holder 1 on the truss form are shown in FIG. 4*a*, 4*b*, and 4*c*. In this, the truss holder 1 is additionally provided with an adjustable carrier 30. As FIG. 4*a* shows, the truss holder 1 is placed on the upper flange 41 of a wooden form carrier 40 in the first step of assembly. Two side carriers 52 are inserted between the truss holder 1 with the adjustable carrier 30 and a side face 50 of the form skin, the first being placed directly on the wooden form carrier 40 and the second on the holding plate 32 of the adjustable carrier 30. The truss holder with the adjustable carrier is pushed with the side carriers and side face along the wooden form carrier 40, which serves as a transverse carrier, towards a base plate 51 of the form skin (see arrow) until the gap between the side face 50 and the base plate 51 is sealed. FIG. 4*a* shows how the screw bolt 2 is connected via the bracket 5 with both holding brackets 3 in a knuckle joint arrangement.

As FIG. 4*b* shows, the truss holder is prestressed in such a manner in a second assembling step that both claws 10 respectively lie with one edge 18 (cf. FIG. 5*a*) on the contacting surface 42 on the lower side of the upper flange 41 of the wooden form carrier 40. The claws 10 are respectively arranged at such an angle on the clamping bracket 3 that when respectively only one edge of the claws 10 lies against the contacting surface 42 after the prestressing of the truss holder, the middle surface of the claw respectively forms an angle of a few degrees with the contacting surface 42. FIG. 4*b* shows that the longitudinal axis of the screw bolt 2 and the longitudinal axes of the straight legs of the clamping brackets 3 are not arranged coaxially, but that they are respectively inclined to the plane of the side face 50. In this case, the longitudinal axis of the screw bolt 2 and the longitudinal axes of the holding brackets 3 are respectively parallel to the plane defined by the support frame and the ends of the straight legs of the holding brackets 3 remote from the joint are oriented more towards the side face 50 than the end of the screw bolt 2 near the joint.

Figure 5A:
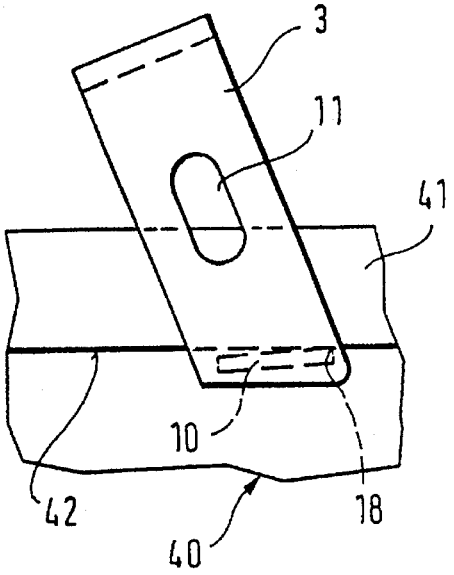
FIG. 5*a* shows a holding bracket leg with a claw according to a first embodiment in side view prestressed on the form carrier.

As can be seen in FIG. 4*c*, the truss holder is tightened to such an extent after prestressing by means of tightening the star nut 4 (see upper arrow) that the longitudinal axis of the screw bolt 2 and the longitudinal axes of the straight legs of the clamping brackets 3 are substantially aligned coaxially and, correspondingly, the contacting surfaces of the claws 10 lie against the contacting surfaces 42 of the upper flange 41 on account of rotation about their contacting edges 18 (cf. FIG. 5*a*). Due to the rotation of the clamping brackets 3 about the contacting edges 18, the support rail 6 is displaced by means of the bolts 14 along a prestressed path, which in the depicted exemplified embodiment can amount to several millimeters in the direction towards the side face 50 (see lower arrow). On account of this prestressing perpendicular to the plane of the side face 50, it is ensured that the gap between the form skin of the side face 50 and the base plate 51 is maintained in a sealing manner even when the pressure of the concrete acts on the side face 50.

FIG. 5*a* to FIG. 5*e* show various embodiments of the claws on the holding brackets 3, the holding brackets respectively being shown in the prestressed state. The oblong hole 11 in the straight leg of the holding bracket 3 can also be clearly seen.

Figure 5B:
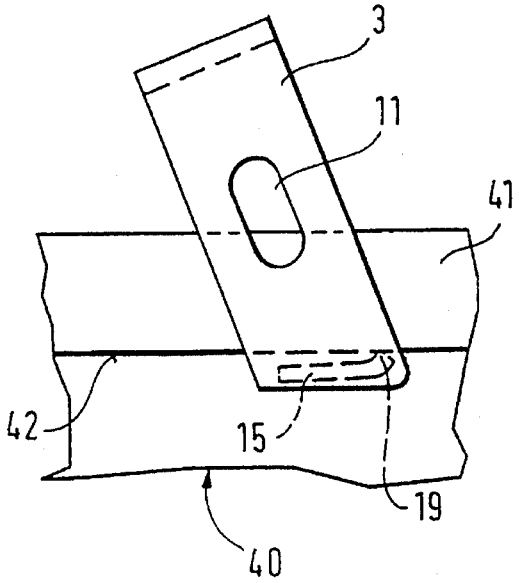
FIG. 5*b* shows a holding bracket leg with a claw according to a second embodiment in side view prestressed on the form carrier.
Figure 5C:
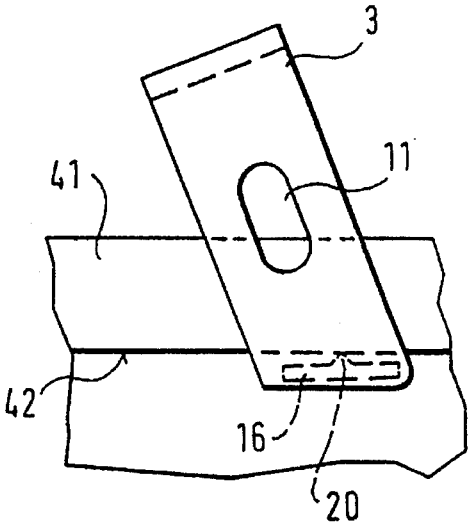
FIG. 5*c* shows a holding bracket leg with a claw according to a third embodiment in side view prestressed on the form carrier.
Figure 5D:
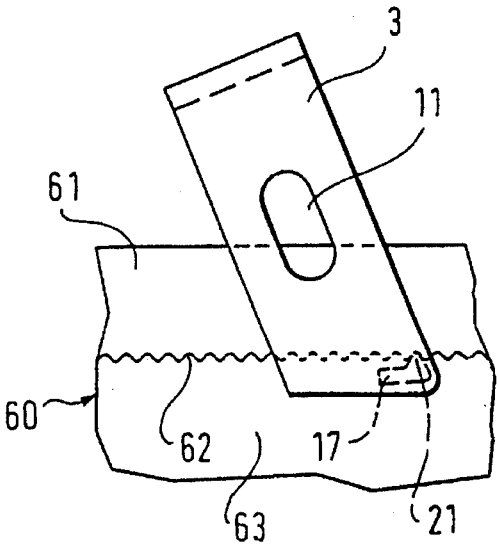
FIG. 5*d* shows a holding bracket leg with a claw according to a fourth embodiment in side view prestressed on the form carrier.
Figure 5E:
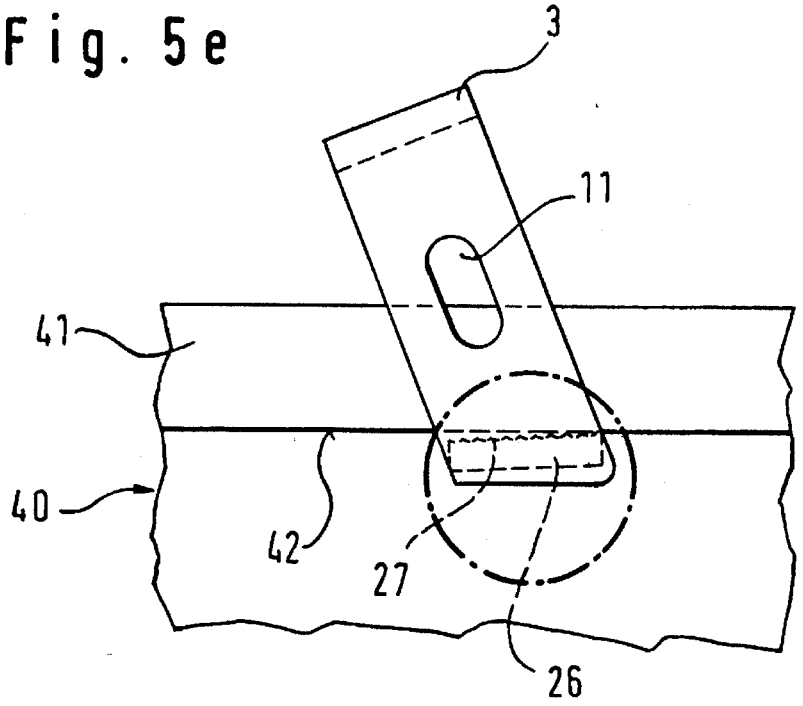
FIG. 5*e* shows a holding bracket leg with a claw according to a fifth embodiment in side view prestressed on the form carrier.

In FIG. 5*a* to 5*c* as well as in FIG. 5*e*, the claws are respectively prestressed on the contacting surface 42 on the lower side of the upper flange 41 of a wooden form carrier 40. In a first embodiment according to FIG. 5*a*, the claw 10 is a flat plate and it lies with the contacting edge 18 on the contacting surface 42. It can be recognized that the middle surface of the contacting claw 10 forms an angle of a few degrees with the contacting surface 42 in the prestressed state of the truss holder, as is the case in the embodiments according to FIG. 5*b* to 5*e*. In a second embodiment according to FIG. 5*b*, the claw 15 is formed of a flat plate in which the end face 19 facing the side face 50 is bent upwardly in the direction of the oblong hole 11. The claw 15 also lies only with one edge against the contacting surface 42.

As FIG. 5*c* shows, a third embodiment of the claw 16 consists in that an elevation in the form of a triangular prism 20 is formed on a flat plate, the elevation being arranged in the middle of the contacting surface on the side of the claw and extending perpendicularly across the plate. The contact of the claw 16 with the wooden form carrier 40 ensues by means of the edge which is formed by the elevation 20.

FIG. 5*d* shows a fourth embodiment of the claw 17 which can be used in connection with metal form carriers 60. The claw 16 is formed of a flat plate which in comparison to the embodiments according to FIG. 5*a* to 5*c* is shorter and has at its one edge an elevation 21 which extends perpendicularly to the plate. The elevation 21 fits exactly into the wave-shaped profile 62 on the lower side of the upper flange 61. As the elevation 21 has a round tip which acts together with the matching wave-shaped profile 62, the claw 17 is securely fixed in the axial direction of the metal form carrier 60 and the rotation of the holding bracket 3 about the contacting edge of the claw is possible without problems when tightening the truss holder.

Figure 5F:
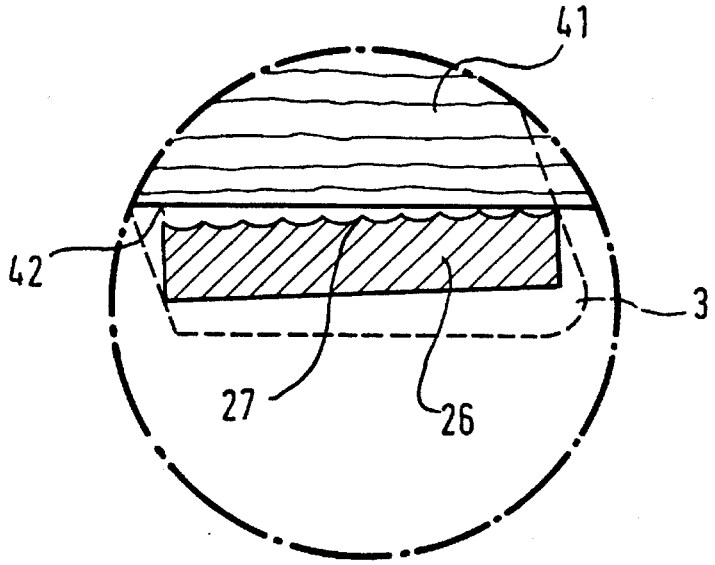
FIG. 5*f* shows a sectional view of the claw according to FIG. 5*e;*

A fifth embodiment of the claw 26 is shown in FIG. 5*e* in which the contacting surface of the claw is provided with a continuous toothing 27. As the enlarged depiction of the claw 26 in FIG. 5*f* shows, the toothing 27 extends across the entire length of the claw and the teeth rows extend perpendicular to the carrier longitudinal axis across the entire width of the claw.

In addition to the described embodiments, the claws can also have other geometrical forms, for example those which are not substantially plate-like are provided with a contacting edge and allow a rotation of the claw about this edge.

Figure 6:
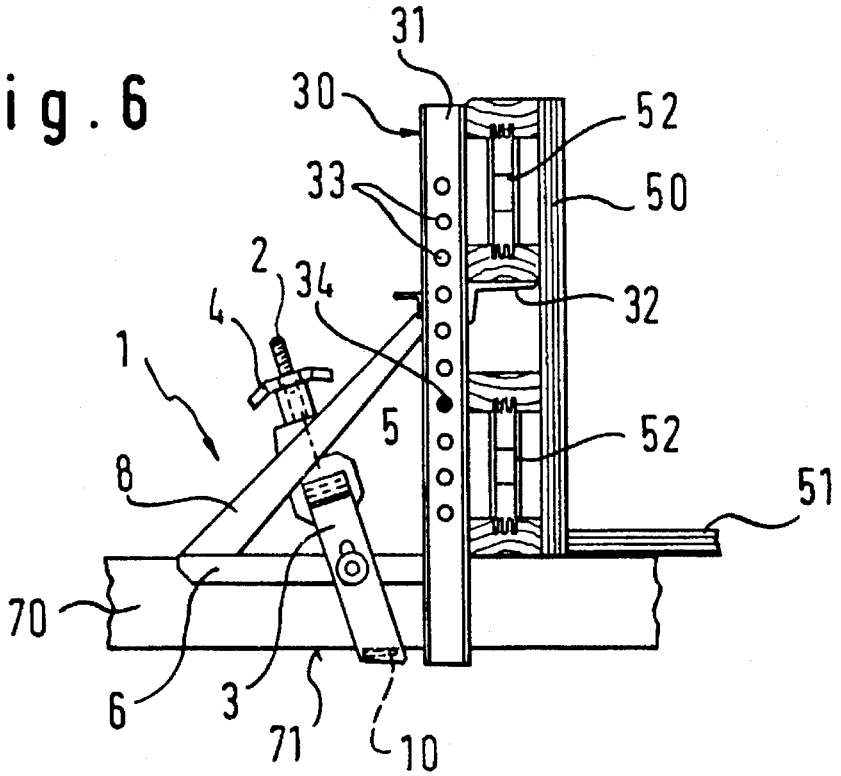
FIG. 6 shows a truss holder with an adjustable carrier in side view finally tightened on a truss form with a square timber form carrier.

FIG. 6 shows a truss holder 1 with an adjustable carrier 30 which is finally tightened to a truss form, the transverse carrier of which is a square piece of timber 70. In order to be able to mount the truss holder to this, the straight legs of the holding brackets 3 are longer than in the embodiments of the truss holders which are provided for mounting to wooden form carriers or metal form carriers with a double T-profile or a T-profile. In the case of these form carriers, respecively one upper flange 41, 61 and one web 43, 63 are present, while a square timber form carrier 70 has a rectangular cross section. The claws 10 of the holding brackets 3 are therefore placed on the lower side 71 of the square timber form carrier 70.

Figure 7:
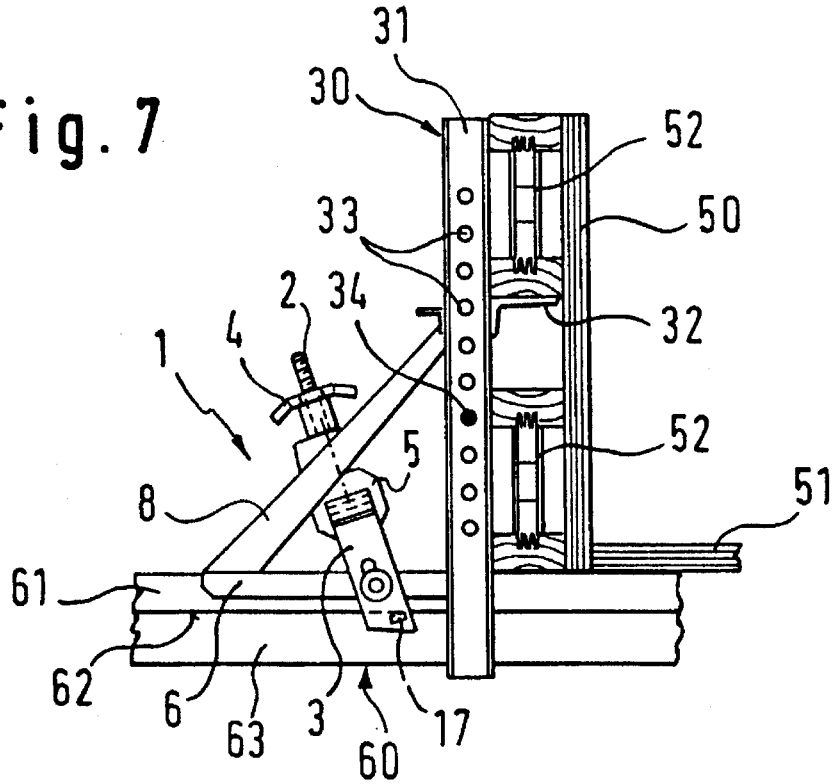
FIG. 7 shows a truss holder with an adjustable carrier in side view finally tightened on a truss form with a metal form carrier.

The depiction in FIG. 7 corresponds to the situation in FIG. 6, but the truss holder is tightened on a metal form carrier 60 rather than a square timber form carrier. In this case, the lower side of the upper flange 61 has a wave-shaped profile 62, which is shown in FIG. 5*d*, in order to also guarantee a good and secure contact of the claw on the metal form carrier.

Figure 8A:
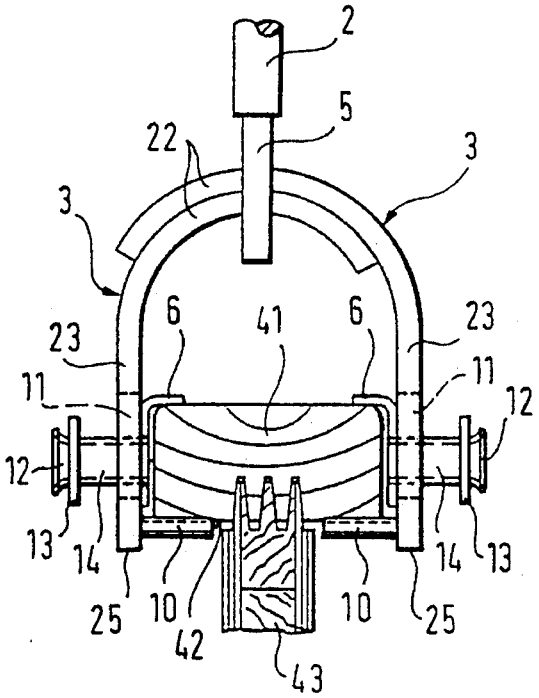
FIG. 8*a* shows a partial front view of a truss holder prestressed on a wooden form carrier.
Figure 8B:
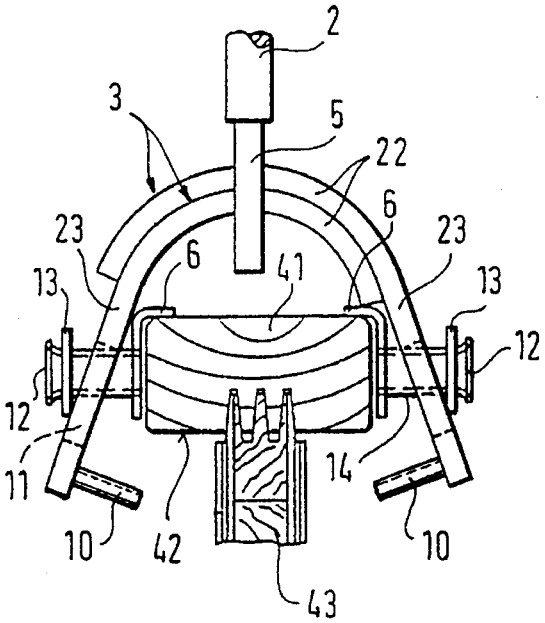
FIG. 8*b* shows a partial front view of a truss holder upon placement against a wooden form carrier.

FIG. 8*a* and 8*b* respectively show the truss holder On a wooden form carrier with a double T-profile in a finally tightened state and in the case of placement on the upper flange 41 of the form carrier. In the clamped state according to FIG. 8*a*, the straight legs 23 of both holding brackets 3 are substantially parallel to one another. However, in order for the claws 10 to be able to grip beneath the upper flange 41 when mounting the truss holder, the superimposed holding brackets 3 can be displaced with respect to one another along their bent sections 22 and can therefore be spread apart perpendicularly to the plane clamped by the support frame. In order to achieve a good form-lock of both superimposed clamping brackets in the area of their bent sections 22, the outer radius of the bent section of the lower clamping bracket corresponds to the inner diameter of the bent section of the upper clamping bracket. The straight leg 23 of the upper clamping bracket is extended to such an extent that the free lower ends 25 of the superimposed holding brackets 3 and the claws 10 are at the same level. The holding brackets 3 have, for example, a flat rectangular section, but can also have other cross-sections which are connectable in a form- and force-locked manner. It is not necessary in this case that the cross-sections of both superimposed clamping brackets are geometrically similar. Furthermore, it is possible to arrange the clamping brackets to be behind one another instead of being superimposed.

Figure 9A:
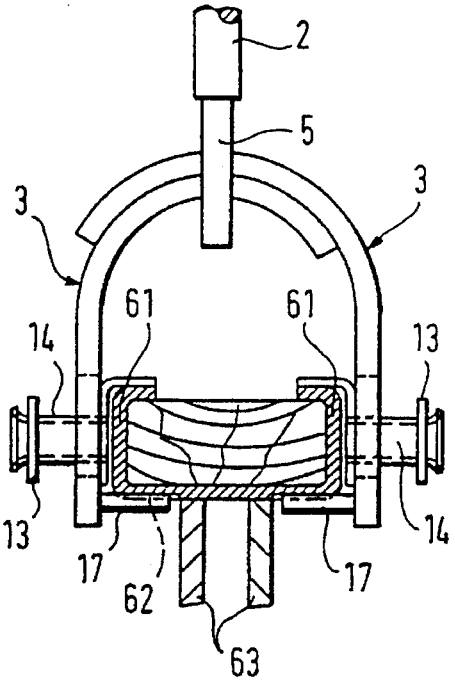
FIG. 9*a* shows a partial front view of a truss holder tightened on a metal form carrier.
Figure 9B:
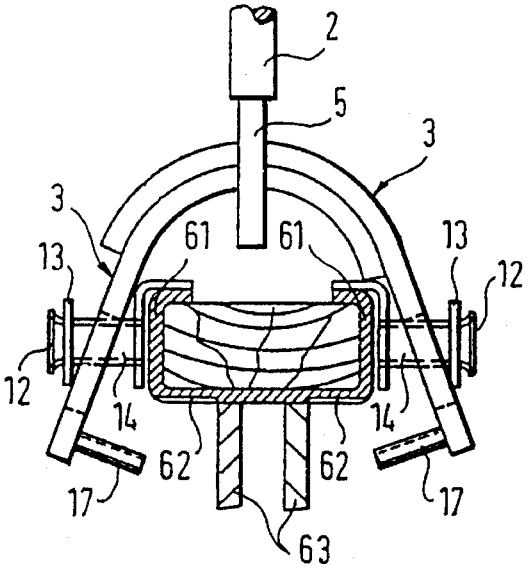
FIG. 9*b* shows a partial front view of a truss holder upon placement on a metal form carrier.

FIG. 9*a* and 9*b* respectively correspond to FIG. 8*a* and 8*b*, but in this case the truss holder is placed on a metal form carrier. One can recognize how the claws 17 engage in the wave-shaped profiles 62 of the upper flange 61.

I claim:

1. Apparatus for supporting a form member extending in a direction perpendicular to the longitudinal axis of a form carrier, comprising:

a support frame having a support member for placement parallel to and against the form carrier, a supporting element arranged perpendicular to the support member and securely fastened thereto, and a strut connecting the support member to the supporting element, and a tightening device mounted on the support frame, the tightening device having tightening means and holding means, the holding means for engaging surfaces of the form carrier for fixing the apparatus to the form carrier, the tightening means being coupled to the strut for tightening the form carrier to the support frame, the tightening means and the holding means being coupled to one another to form a knuckle joint.

2. Apparatus according to claim 1, wherein the tightening means is connected to the holding means by the knuckle joint, said knuckle joint permitting movement of the holding means relative to the tightening means at least within a plane defined by the support frame, the tightening means and the holding means being in a plane parallel to the plane defined by the support frame and positioned at an inclination to the longitudinal axis of the supporting element in such a manner that the side of the holding means facing away from said knuckle joint and the side of the tightening means facing said knuckle joint respectively, face in the direction of the support member, the holding means being oriented more in the direction towards the supporting element than the tightening means, when the apparatus is prestressed.

3. Apparatus according to claim 1 or 2, wherein the holding means comprises two claws.

4. Apparatus according to claim 3, wherein each said claw is substantially plate shaped and is arranged at such an angle that when the apparatus is placed on a form carrier and prestressed, each said claw has a contacting surface extending perpendicular to the longitudinal axis of the carrier with an edge for engaging an opposing surface on the form carrier, the contacting surface of the claw having a middle portion spaced from and forming an acute angle with the opposing surface on the form carrier.

5. Apparatus according to claim 4, wherein the claw (10) is formed on a flat plate.

6. Apparatus according to claim 4, wherein the claw has a width dimension extending across the form carrier and has a protrusion extending perpendicular to the carrier longitudinal axis and across the width of the claw positioned either in the middle portion or at an edge of the contacting surface of the claw facing the form member.

7. Apparatus according to claim 4, wherein the claw comprises an end face facing the form member and extending perpendicular to the carrier longitudinal axis, said end face being bent upwardly in a direction towards the contacting surface of the form carrier.

8. Apparatus according to claim 4, wherein the claw is comprised of teeth extending over the entire contacting surface of the claw substantially perpendicularly to the carrier longitudinal axis.

9. Apparatus according to claim 1, wherein the holding means comprises two holding brackets for connection in a form- and force-locked manner.

10. Apparatus according to claim 9, wherein each holding bracket has a straight leg to which a bent section is connected.

11. Apparatus according to claim 9 wherein each holding bracket has a through hole and a bolt fastened to both sides of the support member perpendicular to its longitudinal axis, the bolt fitting through the through hole of each holding bracket, and a holding device provided on the bolt which holds the holding bracket to be axially displaceable on the bolt.

12. Apparatus according to claim 11 wherein the holding device has a radially outwardly expanding collar section at a free end of the bolt, a stop disc axially displaceable on the bolt, the outer diameter of the stop disc being greater than the diameter of the through hole of the holding bracket and the inner diameter of the stop disc being smaller than the outer diameter of the collar section.

13. Apparatus according to claim 1 wherein the tightening means comprises, a screw bolt and a screw nut threadably fastened to the screw bolt for tightening to the support frame.

14. Apparatus according to claim 13 wherein the screw nut is a star nut.

15. Apparatus according to claim 13 wherein the joint-sided end of the screw bolt is formed as a bracket.

16. Apparatus according to claim 1 wherein the support member of the support frame is a support rail comprising either two L-profiles or a U-profile.

17. Apparatus according to claim 1 wherein the supporting element of the support frame is substantially U-shaped in cross section with through holes arranged in a grid.

18. Apparatus according to claim 17, wherein the form carrier is adjustable in height and placed with a holding plate on the supporting element and is displaceable in a direction parallel to the longitudinal axis of the supporting element, the adjustable carrier having through holes matching through holes of the supporting element and being arranged in a grid matched to the through holes of the supporting element, the adjustable carrier being fixable on the supporting element by a holding bolt insertable through the grid matched through holes.

* * * * *